US007011222B2

(12) United States Patent
DeJonge

(10) Patent No.: US 7,011,222 B2
(45) Date of Patent: Mar. 14, 2006

(54) DESICCANT BASKET FOR MEDICATION CONTAINERS

(76) Inventor: Stuart W. DeJonge, 1770 The Hideout, Lake Ariel, PA (US) 18436

( * ) Notice: Subject to any disclaimer, the term of this patent is extended or adjusted under 35 U.S.C. 154(b) by 162 days.

(21) Appl. No.: 10/463,942

(22) Filed: Jun. 18, 2003

(65) Prior Publication Data

US 2004/0256400 A1 Dec. 23, 2004

(51) Int. Cl.
*B65D 25/02* (2006.01)

(52) U.S. Cl. ..... 215/386; 206/540; 206/814; 220/694

(58) Field of Classification Search ..... 220/23.87, 220/694; 99/312; 210/474; 215/386; 206/540, 206/814

See application file for complete search history.

(56) References Cited

U.S. PATENT DOCUMENTS

| | | | | |
|---|---|---|---|---|
| 1,541,127 | A | 6/1925 | Elmer | |
| 2,275,293 | A | 3/1942 | Foley | |
| 2,758,932 | A | 8/1956 | Scott | |
| 3,033,409 | A * | 5/1962 | Lind | 206/540 |
| 3,592,126 | A * | 7/1971 | Dombrowik | 99/312 |
| 3,820,309 | A | 6/1974 | Cullen et al. | |
| 3,918,578 | A | 11/1975 | Cullen et al. | |
| 3,930,280 | A | 1/1976 | Vasas | |
| 3,940,112 | A * | 2/1976 | Lea | 254/399 |
| 4,077,536 | A | 3/1978 | Brandtberg | |
| 4,460,090 | A | 7/1984 | Paoletti | |
| 4,811,856 | A | 3/1989 | Fischman | |
| 5,252,204 | A * | 10/1993 | Chiodo | 210/232 |
| 5,318,183 | A | 6/1994 | Cohen et al. | |
| 5,738,234 | A | 4/1998 | Harrold | |
| 6,343,458 | B1 | 2/2002 | Merrell | |

* cited by examiner

*Primary Examiner*—Joseph C. Merek
(74) *Attorney, Agent, or Firm*—Kenneth P. Glynn

(57) ABSTRACT

A container insert includes: (a) a cup member having a central axis, the cup member being defined by a center base and a plurality of radiant support members, the radiant support members extending outwardly and upwardly from the center base with space therebetween; and, (b) a rigid stem member having a first end and a second end, the stem member being connected to the cup member at the first end along the central axis and extending downwardly therefrom away from the radiant support members. The cup member center base may be flat, tapered or otherwise and may include or exclude sidewalls. The cup member base may be circular from atop view, or could be some other configuration. Any workable shape may be utilized, such as a hexagon, pentagon, or shapes including straight edges and arcuated edges. A handle may also be attached to the base or a support member.

12 Claims, 5 Drawing Sheets

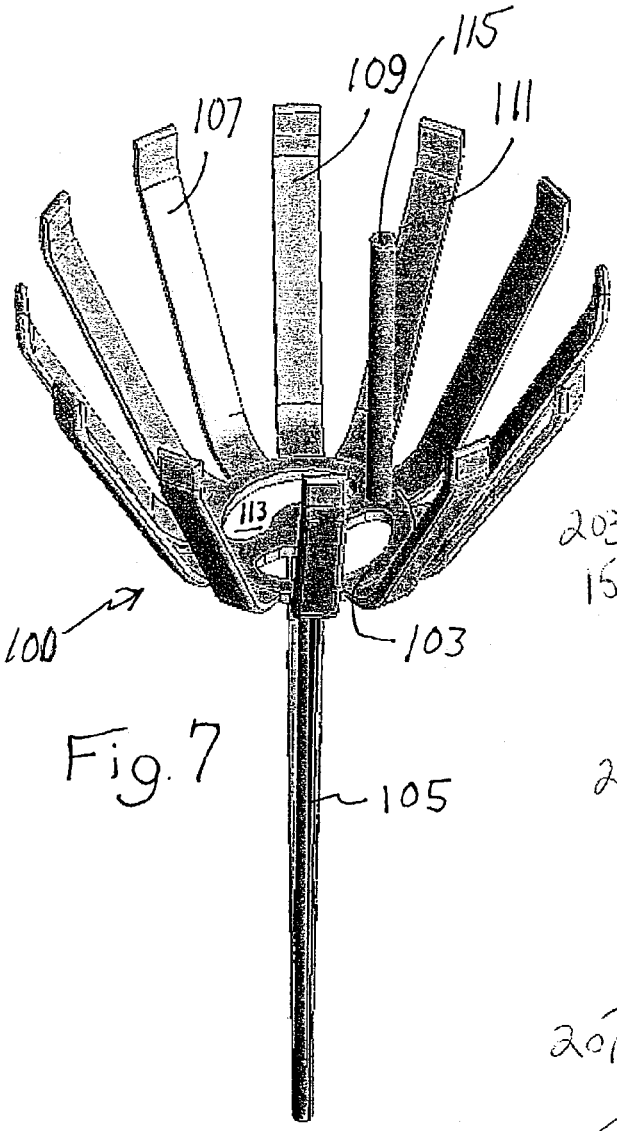
Fig. 7
Fig 8
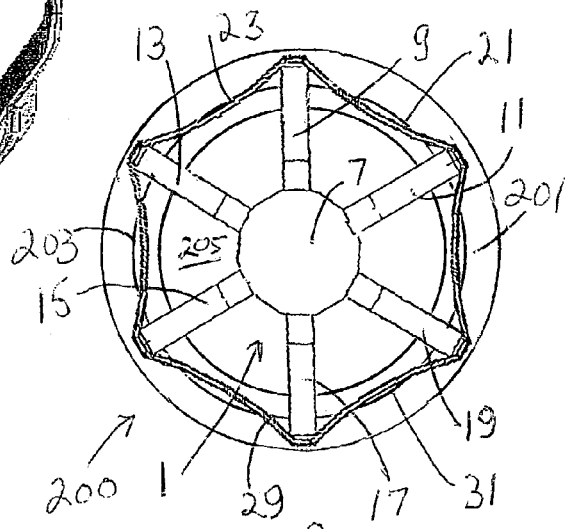
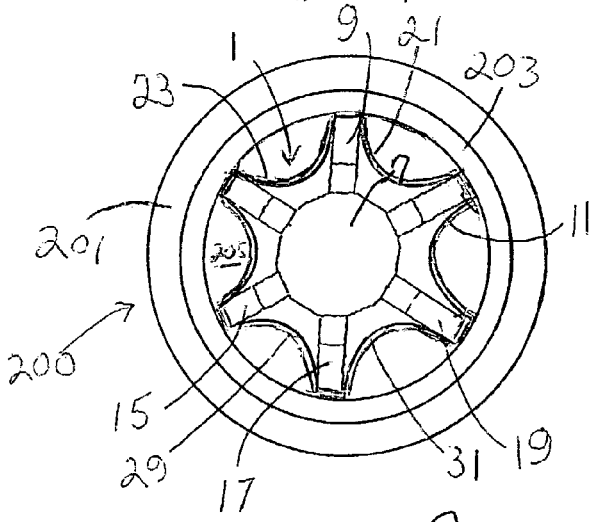
Fig. 9

DESICCANT BASKET FOR MEDICATION CONTAINERS

BACKGROUND OF THE INVENTION

1. Field of the Invention

The present invention relates to container inserts, and more particularly to container inserts for supporting a desiccant strategically positioned away from tablets or pills contained therein. The present invention device includes a cup member and a rigid stem member. The cup member has a continuous loop top that is partially collapsible accommodate different size openings/containers.

2. Information Disclosure Statement

The following patents represent several variations on container inserts which exemplify the art:

U.S. Pat. No. 1,541,127 teaches a combination with a hollow cover of a two part perforated container, the perforated parts being threaded together and adapted to receive and fully enclose a powdered absorbing material, a plurality of resilient members secured to the top of one of said parts and flaring downwardly and outwardly therefrom, and an elastic member on the free end of each said resilient member adapted to engage the inner wall of the lower portion of the cover and space the container therefrom.

U.S. Pat. No. 2,275,293 describes a container, display and dispenser comprising a transparent hollow body member, a transparent inverted cone having its upper edges attached to said body member and suspended within said body member, said cone adapted to hold contents to be dispensed, a fixed closure attached to said body member and covering the top of said cone, a movable closure rotatably positioned on the upper portion of said body member and above said fixed closure, said closures both having openings, said movable closure in normal position with its opening not in registry with the opening of said fixed closure, said movable closure rotatable for registering its opening with the opening of said fixed closure so that upon tilting of said body member, the contents of the cone may be directed toward said openings and dispensed therethrough.

U.S. Pat. No. 2,758,932 describes an article of manufacture comprising a hermetically-sealed package containing a product normally subjective to oxidative deterioration, a deoxygenating body, and a moisture proof oxygen-permeable barrier interposed between said product and said body to prevent direct contact therebetween, said body comprising a dispersion of water, glucose and an enzyme system having oxidase activity.

U.S. Pat. No. 3,820,309 describes an adsorbent cartridge containing an adsorbent which may also be a desiccant, for insertion into a container comprising a permeable casing having a longitudinal axis and a cylindrical side wall and substantially planar opposed end walls extending substantially perpendicularly to said side wall and adsorbent material in said casing. A combination of a container and an adsorbent cartridge with said container having a substantially Cylindrical side wall and a bottom wall. And an adsorbent cartridge in said container, said adsorbent cartridge having a substantially planar bottom wall for resting on said bottom wall of said container and also having a substantially cylindrical side wall for positioning throughout its extent in close proximity to the side wall of said container, and a top wall on said adsorbent cartridge for acting as a shelf to support the contents of said container.

U.S. Pat. No. 3,918,578 teaches a desiccant end cap for mounting on a hollow cylindrical member having an annular flange with a face portion and an outer annular portion extending transversely thereto comprising a cup-like member having an end portion and an annular rim extending substantially perpendicularly to the end portion for overlying said outer portion of said flange with an interference fit desiccant container means mounted centrally on said end portion for positioning within said hollow tubular member, spacer dimples on the end portion of said cap for positioning said end portion in spaced relationship to the face portion of the flange and latching dimples on said rim for engaging said flange with a holding fit.

U.S. Pat. No. 3,930,280 teaches that leaks are precluded in product containers with the bottle insert by structuring a rim thereon for establishing an inclined sealing interface. A diaphragm is structured within the bottle insert to provide either a cylindrical or noncylindrical wipe over the particular type of applicator tip selected for use in the product container. Furthermore, provisions are incorporated within the bottle insert to block passage through the wiping diaphragm of misaligned comb type applicator tips and these provisions are made self-aligning for such tips with minor structural modification.

U.S. Pat. No. 4,077,536 describes a plastic insert for sealing caps such as crown corks, which is capable of forming a seal impermeable to liquid when it is pressed by the cap against the beaded mouth of a container. The insert comprises a central projection directed towards the interior of the container. This projection may comprise a transverse hole and/or a longitudinal hole rendering it possible to apply by means of a drawing pin or a safety pin or sew by means of a needle the insert onto a blouse or a display card board. In this manner the insert may be used as a trimming thus offering a certain advertisement to the manufacturer of the contents of the container.

U.S. Pat. No. 4,460,090 relates to a container which is intended to hold pills, and it composes on the one hand an external, rigid envelope and on the other hand an internal envelope enclosing the pills, this internal envelope being elastically deformable and capable of an increase in volume which is sufficient for absorbing the surplus pressure resulting from the packing of the pills when the lid is applied, without crushing the pills. In a first embodiment, the internal envelope is cylindrical and it has a convex, deformable base. In a second embodiment, the internal envelope is a sleeve provided with at least one slit allowing its radial expansion.

U.S. Pat. No. 4,811,856 teaches an audible sound protecting mechanism and a tamper proof disc to prevent and deter persons from implanting contaminated substances into bottles containing capsules, tablets or caplets, removing the contents of the bottle, changing their composition, replacing the contents back into the bottles and restoring the bottle to its original condition so as to appear untouched, for the purpose of doing harm to another person. The safety disc that protects the products is so positioned inside the neck of the bottle, that is beyond the reach and manipulations of anyone; therefore, if broken, the safety disc cannot be replaced, repaired, or repositioned.

U.S. Pat. No. 5,318,183 describes a bottle having an inserted tube in its neck to effectively reduce its interior volume and allow a large surface area for the bottle exterior, e.g. for supporting a large label or to allow oversized print, with a relatively small interior volume, e.g. to prevent abrasions caused by the interior contents moving excessively against each other.

U.S. Pat. No. 5,738,234 describes a container insert for volume reduction and tablet stability. It includes a flexible cup member and a rigid stem member. The flexible cup member is comprised of a plurality of correlate petal-like appendages and a hollow stem member. When the container insert is inserted into the mouth of a container, the flexible cup member appendages are flexed inwardly thereby permitting the insert to be fully inserted. When the insert is in place, it may either reside in the base of a container or, alternatively, in the neck of the same. When flexed, the petal-like appendages conform to the shape and dimension of the inside of the container. To accomplish such conformation, the appendages are capable of successive offset overlapping so as to form a bowl-like shape once inserted, much like the petals of a tulip. Preferably, the cup member includes a centrally located mound, and the stem member includes a desiccant retaining element and at least one venting cut-out.

U.S. Pat. No. 6,343,458 teaches a packaging system and method is provided which will substantially retard or reduce the caking of powdered, crystalline, or granular organic and inorganic cakable chemical compounds and mixtures thereof. Such retardation and reduction in caking enhances the free flowability and scoopability of the compound. The packaging system and method comprises a moisture impermeable container, a moisture impermeable cover which closes the container, providing a moisture tight seal between the container and cover such as with a gasket, and desiccant. The compound can be placed directly into the container or into a moisture permeable bag which is sealed after the compound has been placed therein. The bag is filled or sized so that there will be a void space in the container once the container is closed. The desiccant is placed in the void space. The drum may be a fiber board drum having a moisture impermeable liner, such as an aluminum liner. The cover is preferably a plastic cover. The permeable bag is preferably made of kraft crepe paper or woven polypropylene.

Notwithstanding the prior art, the present invention is neither taught nor rendered obvious thereby.

SUMMARY OF THE INVENTION

The present invention relates to a container insert that includes: (a) a cup member having a central axis, the cup member being defined by a center base and a plurality of radiant support members, the radiant support members extending outwardly and upwardly from the center base with space therebetween; and, (b) a rigid stem member having a first end and a second end, the stem member being connected to the cup member at the first end along the central axis and extending downwardly therefrom away from the radiant support members. The cup member center base may be flat, tapered or otherwise and may include or exclude sidewalls. The cup member base may be circular from atop view, or could be some other configuration. Any workable shape may be utilized, such as a hexagon, pentagon, or shapes including straight edges and arcuated edges.

The container insert radiant support members are partially flexible so as to adapt the container to be capable of being flexibly inserted into the mouth of the container. The present invention container insert radiant support members may have top ends that are connected, partially connected, or unconnected. In some preferred embodiments, the container insert radiant support members are connected to one another by a plurality of band segments forming a continuous loop at or near the top ends. In some embodiments, the plurality of band segments are semi-rigid, flexible band segments. They preferably are adapted to flex inwardly to adapt to a container having an inner diameter smaller than the continuous loop.

In some present invention embodiments, the container insert cup member includes attachment means for receiving a desiccant member thereon. Alternatively, or in addition, a peg or other gripping element may be connected to the device to facilitate insertion and/or removal. Other optional features that may be useful include on cup member at least one orifice to enhance air circulation to increase the effectiveness of the desiccant.

BRIEF DESCRIPTION OF THE DRAWINGS

The present invention should be more fully understood when the specification herein is taken in conjunction with the drawings appended hereto wherein:

FIGS. 5, 6 and 7 illustrate perspective views of alternative present invention container insert embodiments;

FIGS. 8 and 9 show top views of a present invention container insert as shown being inserted and fully inserted into a container.

DETAILED DESCRIPTION OF THE PRESENT INVENTION

Figure 1:
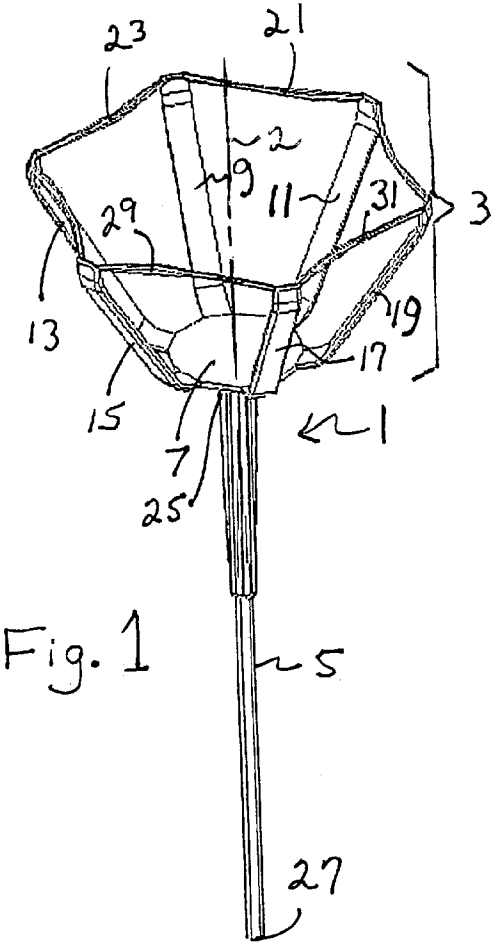
FIG. 1 shows a perspective view of a present invention container insert.

FIG. 1 shows a perspective view of a present invention container insert 1, having a cup member 3, with a central axis 2. Cup member 3 includes a circular base 7. Extending upwardly and outwardly from base 7 are a plurality of radiant support members 9, 11, 13, 15, 17 and 19. (By "radiant" as used herein is meant located at some predetermined radius from the central axis.) These radiant support members 9, 11, 13, 15, 17, and 19 are connected to one another by a plurality of band segments such as band segments 21, 23, 29 and 31.

There is a rigid stem 5 (rigid enough to support the upper portions of the device and its intended desiccant), with an upper end 25 and a lower end 27. Stem 5 essentially runs along the central axis 2, but could be offcenter and still function, and, if desired, more than one stem could be included. Stem 5 is connected to the underside of cup base 7, as sown, and its lower end 27 is intended to rest inside the bottom of a container. This will elevate the cup member 7 in a container above the level of the medicine (powder, gel, capsule, etc. area), so as to maintain the desiccant above the contents to be kept dried.

Figure 3:
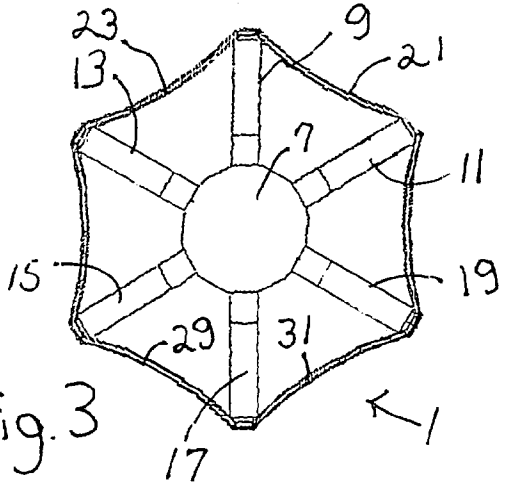
FIG. 3 shows a top view and FIG. 4 shows a bottom view of the present invention container insert shown above.
Figure 4:
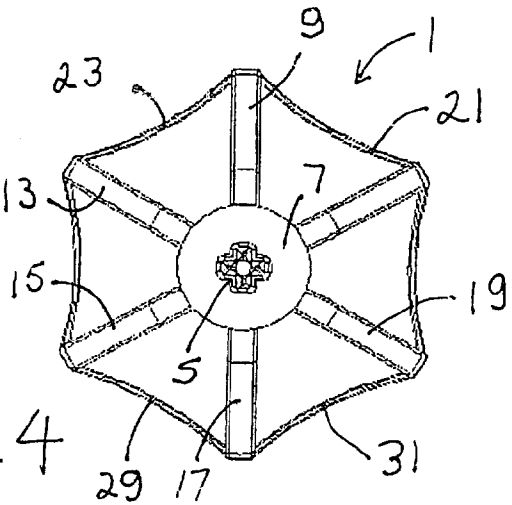
Figure 2:
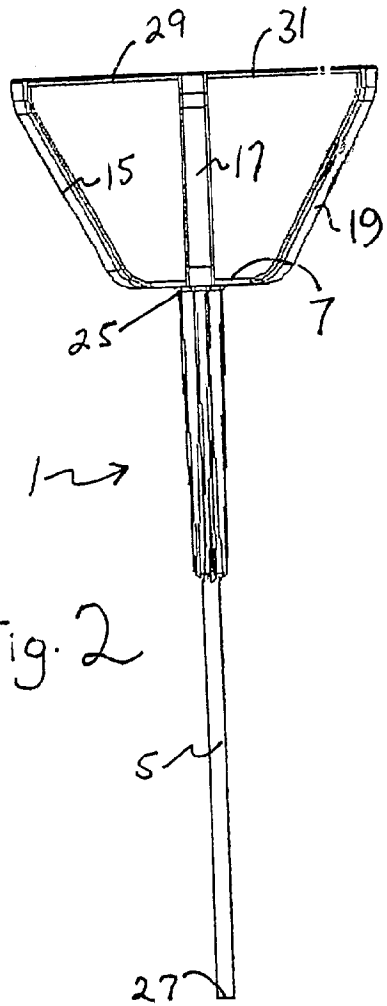
FIG. 2 shows a side view of present invention container insert shown in FIG. 1.

FIG. 2 shows a side view of present invention container insert 1 shown in FIG. 1, FIG. 3 shows a top view and FIG. 4 shows a bottom view of the present invention container insert 1 of Figure. In all of these Figures, identical parts are identically numbered.

Figure 5:
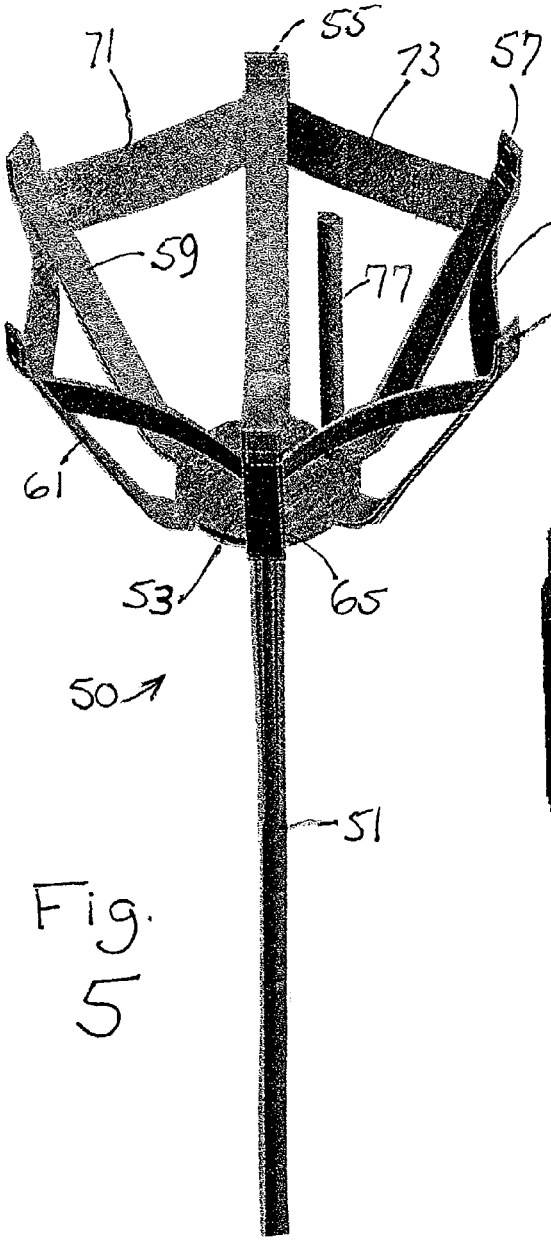
Figure 6:
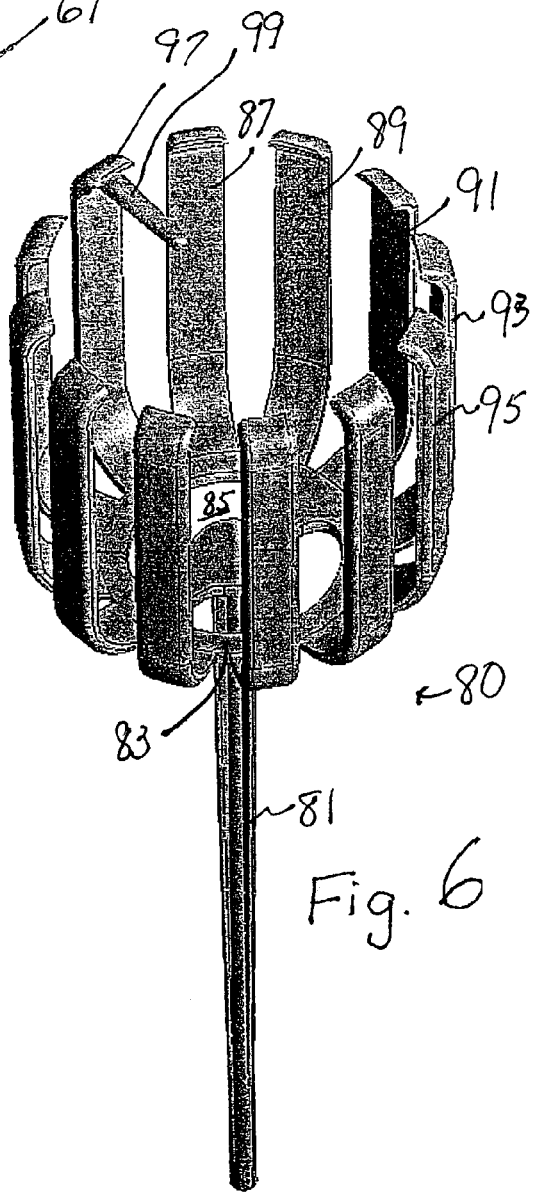

FIGS. 5, 6 and 7 illustrate perspective views of alternative embodiment present invention container inserts 50, 80 and 100, respectively. In FIG. 5, container insert 51 includes a stem 51, a cup base 53, and a plurality of radiant support members 55, 57, 59, 61, 65, and 67, these are connected by a ring of bands, such as bands 71, 73 and 75. There is an upright peg 77 that serves as a handle for insertion and removal into and out of a container. As can be seen in this and other Figures, there is space created between the cup base and the footprint (perimeter) of the supports, and this not only allows for air circulation, but also permits pouring out of the medicine contents from the container without removal of the present invention insert.

FIG. 6 shows an oblique view of present invention insert 80. In this embodiment, there are no bands, and supports, such as supports 87, 89, 91, 93, and 95 are unconnected prong-like elements connected at their bottom ends to cup base 83. Cup base 83 includes orifices, such as orifice 85. Cup base 83 is connected to stem 81, as shown. Support 97 includes a protruding handle 99.

FIG. 7 shows a present invention device that is similar to the FIG. 6 device described above except that the supports fan out instead of being vertical. Here, container insert 100 includes stem 105 connected to cup base 103. Cup base 103 has two openings, such as opening 113 for purposes described above, and has surrounding support members, such as support members 107, 109, and 111. There is an upright handle 115, connected to base 103, as shown.

Figure 10:
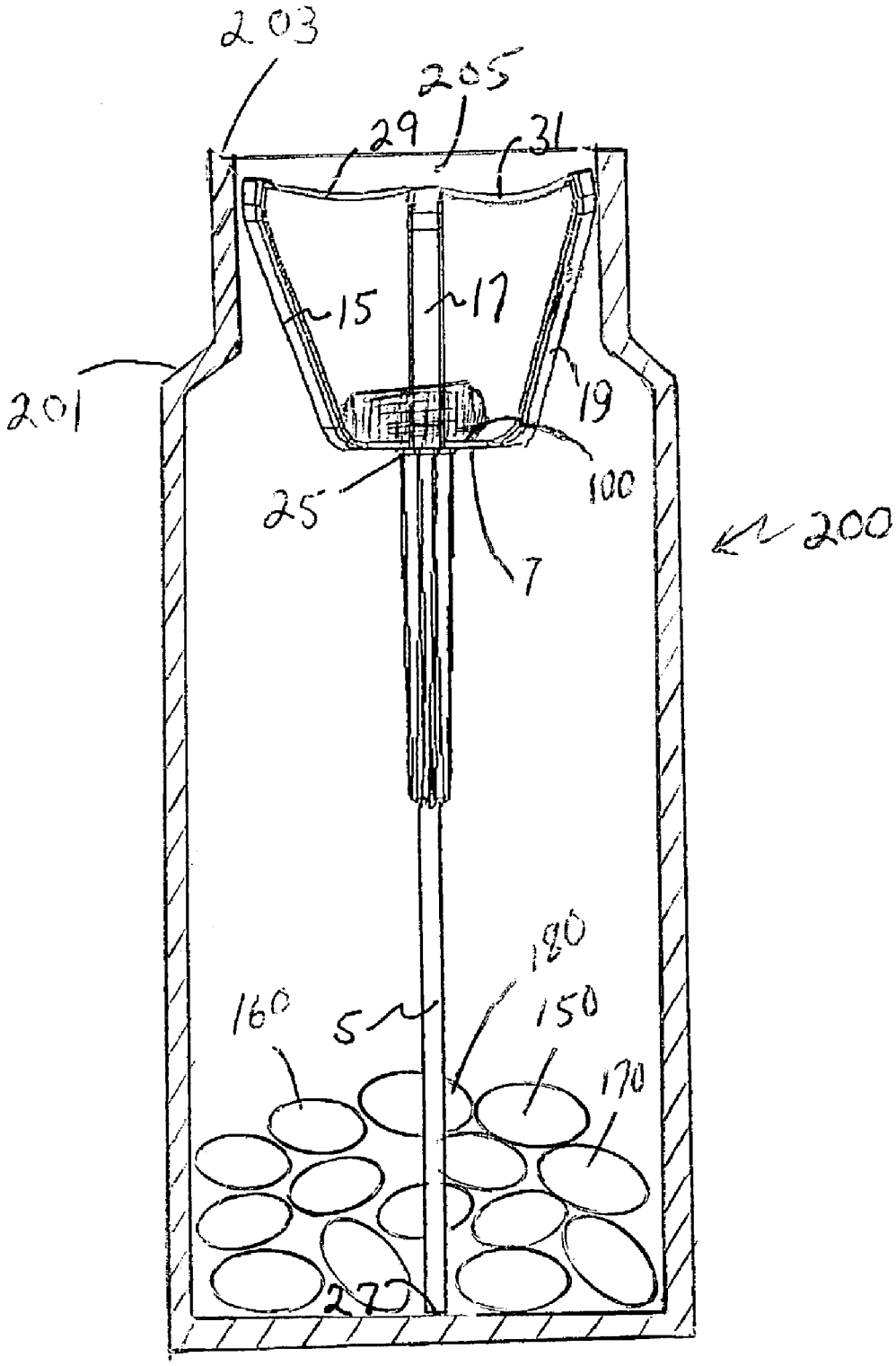
FIG. 10 shows a partially cut side view thereof after the insert has been inserted, and capsules and a desiccant have been added; and, FIGS. 11 and 12 show perspective and side views, respectively, of another preferred embodiment present invention container insert.

FIGS. 8 and 9 show top views of the present invention container insert 1 of FIGS. 1, 2, 3, and 4, now shown as being inserted and fully inserted into container 200, and FIG. 10 shows a partially cut side view thereof after insert 1 has been inserted. In FIGS. 8, 9, and 10, elements already shown in FIGS. 1 through 4 are identically numbered and need not be repeated here. As can be seen in FIG. 8, insert 1 has a larger top footprint perimeter than opening 205 of neck 203 of container 200. (Sidewall 201 of container 200 widens below the neck 203 to create a narrow neck, as shown, and this is typical of many medicine containers.) In order to fit insert 1 into container 200, the support members, e.g. members 9, 11, etc. are springy enough to fold inward slightly, as thbands such as band 21, likes yields. In other words, insert 1 squeezes to a smaller diameter to fit into container 200. Thus, FIG. 8 shows the insert 1 above the container 200 before being pushed into it, while FIG. 9 shows it squeezed and fitted into container 200. FIG. 10 shows a side view of container 200 with insert 1 in place and with capsules such as capsules 150, 160, 170, and 180 and with desiccant 100, as shown.

Figure 11:
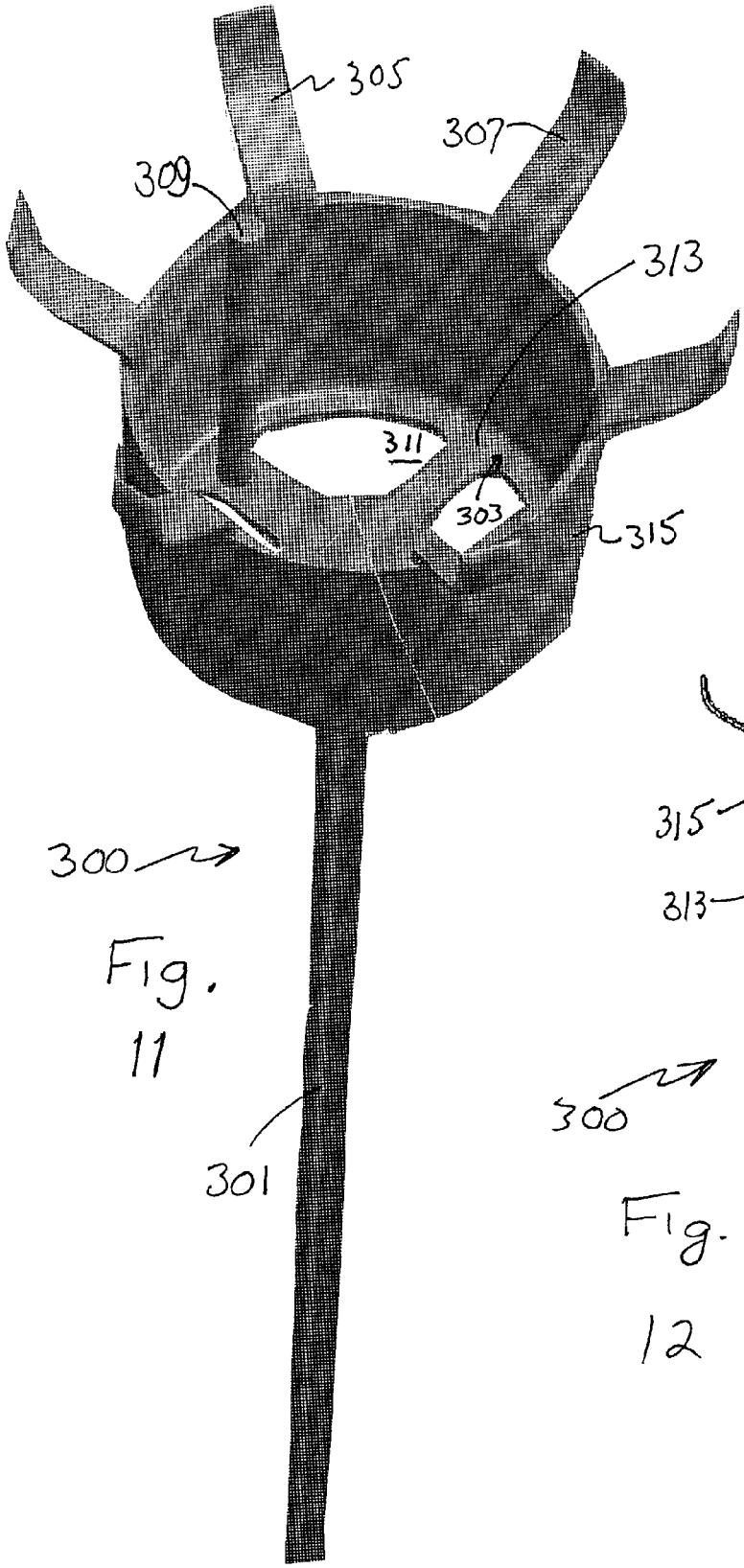
Figure 12:
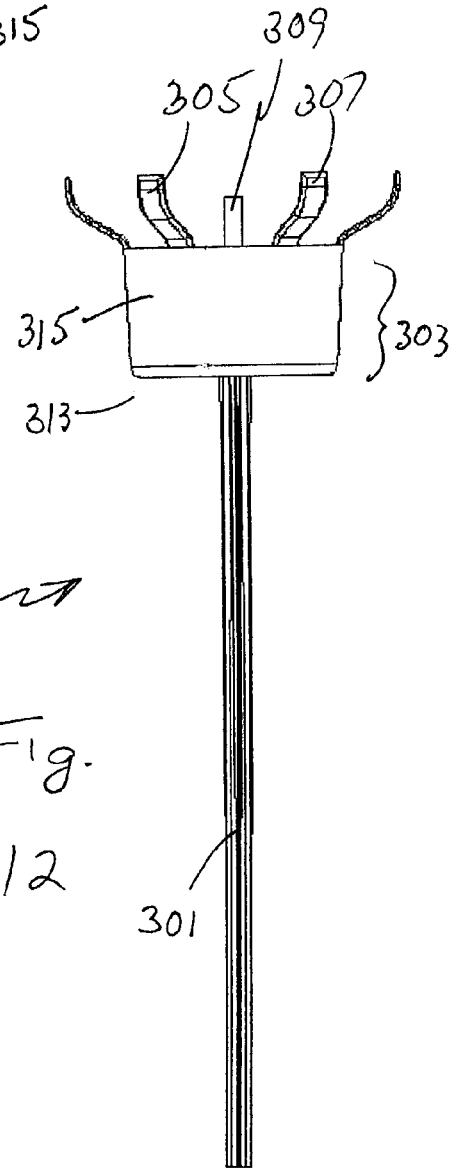

FIGS. 11 and 12 show perspective and side views, respectively, of another preferred embodiment present invention container insert 300. It includes a stem 301, a cup base 303, radiant support members such as support members 305 and 307, handle 309, and orifices such as orifice 311. In this embodiment, cup base 303 includes a bottom 313 and sidewall 315.

Obviously, numerous modifications and variations of the present invention are possible in light of the above teachings. It is therefore understood that within the scope of the appended claims, the invention may be practiced otherwise than as specifically described herein.

What is claimed is:

1. A container insert, comprising:

(a) a cup member having a central axis, said cup member being defined by a center base, said center base includes a bottom and a sidewall and a plurality of radiant support members, each having a lower end and an upper end, each of said radiant support members extending outwardly and upwardly from said sidewall at its lower end such that the upper ends of said radiant support members have a top view footprint perimeter that is larger than the top view footprint of said center base, said radiant support members being spaced apart from one another at both their lower ends and their upper ends such that each radiant support member has no physical contact with any other radiant support members, wherein open space exist between said radiant support members to permit matter to pass therethrough; and, (b) a rigid stem member having a first end and a second end, said rigid stem member being connected to said cup member at said first end along said central axis and extending downwardly therefrom away from said radiant support members.

2. The container insert of claim 1 wherein said container insert radiant support members are partially flexible so as to adapt said container insert to be capable of being flexibly inserted into a mouth of a container.

3. The container insert of claim 1 wherein said cup member has a circular shape.

4. The container insert of claim 1 wherein said radiant support members upper ends that are not connected to one another.

5. The container insert of claim 1 wherein said cup member includes at least one orifice to enhance air circulation and dispensing capabilities.

6. The container insert of claim 1 wherein said container insert further includes a handle connected to at least one of said support members and said cup member.

7. The container insert of claim 6 wherein said handle is connected to said cup member.

8. A container insert and a container device, comprising:

A. a container having a base, a neck and an open mouth, said container having an outer side and an inner side; and B. a container insert being confined within said container, said container insert, comprising:

(a) a cup member having a central axis, said cup member being defined by a center base, said center base includes a bottom and a sidewall and a plurality of radiant support members, each having a lower end and an upper end, each of said radiant support members extending outwardly and upwardly from said sidewall at its lower end such that the upper ends of said radiant support members have a top view footprint perimeter that is larger than the top view footprint perimeter of said center base, said radiant support members being spaced apart from one another at both their lower ends and their upper ends such that each radiant support member has no physical contact with any other radiant support members, wherein open space exist between said radiant support members to permit matter to pass therethrough; and, (b) a rigid stem member having a first end and a second end, said rigid stem member being connected to said cup member at said first end along said central axis and extending downwardly therefrom away from said radiant support members.

9. The container insert and container device of claim 8 wherein said container insert radiant support members are partially flexible so as to adapt said container insert to be capable of being flexibly inserted into a mouth of a container.

10. The container insert and container device of claim 8 wherein said cup member has a circular shape.

11. The container insert and container device of claim 8 wherein said radiant support members have upper ends that are unconnected.

12. The container insert of claim 8 wherein said cup member includes at least one orifice to enhance air circulation and dispensing capabilities.

* * * * *